US006880690B2

(12) United States Patent
Weis

(10) Patent No.: US 6,880,690 B2
(45) Date of Patent: Apr. 19, 2005

(54) DRIVING MEMBER FOR ROTATING COMPONENT INTERGRAL WITH A PRINTING MACHINE AND METHOD FOR SEPARATING SAID DRIVING MEMBER

(75) Inventor: Anton Weis, Lorsch (DE)

(73) Assignee: Koenig & Bauer Aktiengesellschaft, Wurzburg (DE)

( * ) Notice: Subject to any disclaimer, the term of this patent is extended or adjusted under 35 U.S.C. 154(b) by 168 days.

(21) Appl. No.: 10/275,265

(22) PCT Filed: May 15, 2001

(86) PCT No.: PCT/DE01/01833

§ 371 (c)(1),
(2), (4) Date: Nov. 12, 2002

(87) PCT Pub. No.: WO01/87605

PCT Pub. Date: Nov. 22, 2001

(65) Prior Publication Data

US 2003/0106445 A1 Jun. 12, 2003

(30) Foreign Application Priority Data

May 17, 2000 (DE) ..... 100 24 327

(51) Int. Cl.[7] ..... B41F 13/008
(52) U.S. Cl. ..... 192/91 A; 101/479
(58) Field of Search ..... 192/20, 34, 84.6, 192/91 A; 101/216, 248, 479

(56) References Cited

U.S. PATENT DOCUMENTS

| | | | | | |
|---|---|---|---|---|---|
| 3,528,262 | A | | 9/1970 | Fuchs | |
| 4,421,217 | A | * | 12/1983 | Vagias | 192/34 |
| 4,453,464 | A | * | 6/1984 | Weis | 101/216 |
| 4,538,516 | A | * | 9/1985 | Aaron | 101/248 |
| 5,044,481 | A | * | 9/1991 | Yoshida et al. | 192/91 A |
| 5,067,403 | A | * | 11/1991 | Massierer | 101/248 |
| 5,109,969 | A | | 5/1992 | Blaser | |
| 5,215,014 | A | * | 6/1993 | Burger et al. | 101/248 |
| 5,591,921 | A | | 1/1997 | Schaede | |
| 5,701,818 | A | * | 12/1997 | Mohrmann | 192/85 A |
| 5,887,526 | A | * | 3/1999 | Zahnd | 101/218 |
| 6,178,884 | B1 | | 1/2001 | Weschenfelder | |
| 6,192,793 | B1 | * | 2/2001 | Motoe et al. | 101/248 |
| 6,338,298 | B1 | * | 1/2002 | Schneider et al. | 101/220 |
| 6,578,480 | B1 | * | 6/2003 | Konecny | 101/248 |
| 6,601,681 | B1 | * | 8/2003 | Gerner et al. | 192/34 |
| 6,630,659 | B1 | * | 10/2003 | Stridsberg | 250/231.13 |

FOREIGN PATENT DOCUMENTS

| | | |
|---|---|---|
| DE | 1 761 199 | 4/1971 |
| DE | 39 35 450 C1 | 5/1991 |
| DE | 44 36 628 C1 | 4/1996 |
| DE | 195 39 984 A1 | 4/1997 |
| DE | 195 39 984 C2 | 7/1998 |
| DE | 198 03 557 A1 | 9/1999 |
| DE | 198 03 557 C2 | 12/1999 |
| EP | 0 722 831 B1 | 8/1999 |

* cited by examiner

*Primary Examiner*—Richard M. Lorence
(74) *Attorney, Agent, or Firm*—Jones Tullar & Cooper PC

(57) ABSTRACT

A rotating component of a printing machine is driven by a motor. A journal of the rotating components is connected to the shaft of the motor by at least a first coupling. The motor is supported for movement toward and away from the rotating component. The rotating component journal and the motor shaft are connected by the coupling in a manner that allows for the absorption of tensile and pressure stress. A second coupling allows angular movement of the motor shaft and the journal.

16 Claims, 1 Drawing Sheet

DRIVING MEMBER FOR ROTATING COMPONENT INTERGRAL WITH A PRINTING MACHINE AND METHOD FOR SEPARATING SAID DRIVING MEMBER

FIELD OF THE INVENTION

The present invention is directed to a drive mechanism for a rotating component of a printing press, and to a method for disconnecting a drive mechanism from the rotating component. The drive mechanism is connected to the rotating component by a coupling and can be moved axially with respect to the rotating component.

BACKGROUND OF THE INVENTION

A drive mechanism for a rotating component is known from DE 195 39 984 C2, in which a motor is flanged to a lateral frame of a rotary printing press. This motor is connected by a disengagable coupling with a driveshaft which is used for driving several cylinders by use of a gear wheel chain.

DE 198 03 557 C2 discloses a drive mechanism for a rotating component of a printing press. A motor, which can be moved axially in respect to the rotating component, is used for the purpose of coupling and decoupling the rotating component.

An arrangement for an electric motor for driving a rotating body is known from EP 0 722 831 B1. For the purpose of adjusting a side register, the rotor of the electric motor, which is directly connected with the rotating body, can be linearly displaced in relation to the stator. If more lateral displacement is required, the stator itself can also be caused to track.

WO 98/51497 A2 discloses a drive mechanism for a rotating belt in the form of a position- or rpm-controlled motor. The torque is transmitted via a universal joint and torsion-proof couplings from the motor to the rotating component. The universal joint and torsion-proof couplings compensate for angular deviations.

In connection with a drive mechanism for a rotating belt of a printing press, it is known from DE 44 36 628 C1 to provide a coupling which compensates for angular deviations and which transmits axial forces.

DE-OS 17 61 199 discloses a method and a device for exchanging a forme cylinder. A coupling, which acts on a journal on the driven side of the cylinder, is released by remote control and the coupling is pulled off the journal by the use of a precision-type brake motor. The precision-type brake motor is also used for controlling the side register.

SUMMARY OF THE INVENTION

The object of the present invention is directed to providing a drive mechanism for a rotating component of a printing press and to a method for disconnecting a drive mechanism.

In accordance with the present invention, these objects are attained by providing a drive mechanism for a rotating component. The drive mechanism is a motor that is connected to an end face of the rotating component by a coupling. The motor is shiftable axially with respect to the rotating component by use of an actuating drive. The coupling can be controlled by a pressure medium that can be supplied to the coupling through the shaft of the motor. A pulse transducer is useable to provide positional information for the motor and can be placed on the circumference of the coupling. The coupling will be released by remote control prior to shifting of the motor.

The advantages which can be attained by the present invention reside, in particular, in that the drive mechanism for a rotating component in accordance with the present invention accomplishes several tasks. For one, a disconnection of the drive mechanism from the rotating component can take place, for example for the purpose of a relative turning of each component with respect to each other, or for decoupling of the drive and the component. Secondly, a complete separation of the motor from the rotating component, i.e. the release of a mutual penetration, is possible, such as is required for example in a printing press, and in particular in a rotogravure printing press, for exchanging a forme cylinder. This is made possible, in an advantageous manner, by the interplay of a releasable coupling and of a linearly displaceable drive mechanism together with a second coupling which can be exposed to a pressure load and to a tensile load, which, as a rule, is a non-releasable one. Thirdly, by use of the drive mechanism, it is possible, for example during the printing process, to displace the rotating component in its axial direction. For example, if the rotating component is a forme cylinder of a rotogravure printing press, it can be displaced axially for correction purposes, and in particular for adjusting its side register.

In an advantageous manner, driving of the rotating component takes place directly, and therefore without the working of the toothed wheel of a gear. A link joint or a universal joint assigned to the drive mechanism assures a wear-resistant driving operation, even if the motor has not been aligned exactly with the rotating component. The demands made on a solid relative rotary position between the motor, or a pulse transducer, and the rotating component are assured by the use of a torsion-proof embodiment of the link or universal joint and the arrangement of a pulse transducer on the motor shaft in the vicinity of the rotating component. An embodiment of the link or universal joint in a manner in which tension and pressure forces can be absorbed in the axial direction of the rotating component is advantageous. It is furthermore advantageous, in accordance with the present invention, that the relative movement can be performed in an electronically controllable manner, at least without the use of a tool, and without having to remove the motor or the drive mechanism from the printing press. It is also advantageous that the process of coupling and decoupling can also be performed by remote control, wherein the supply of a pressure medium for the switching process takes place through the motor, and in particular along the rotor shaft of the motor, and the drive mechanism.

BRIEF DESCRIPTION OF THE DRAWINGS

A preferred embodiment of the present invention is represented in the sole drawing and will be described in greater detail in what follows.

Shown are in.

DESCRIPTION OF THE PREFERRED EMBODIMENT

Figure 1:
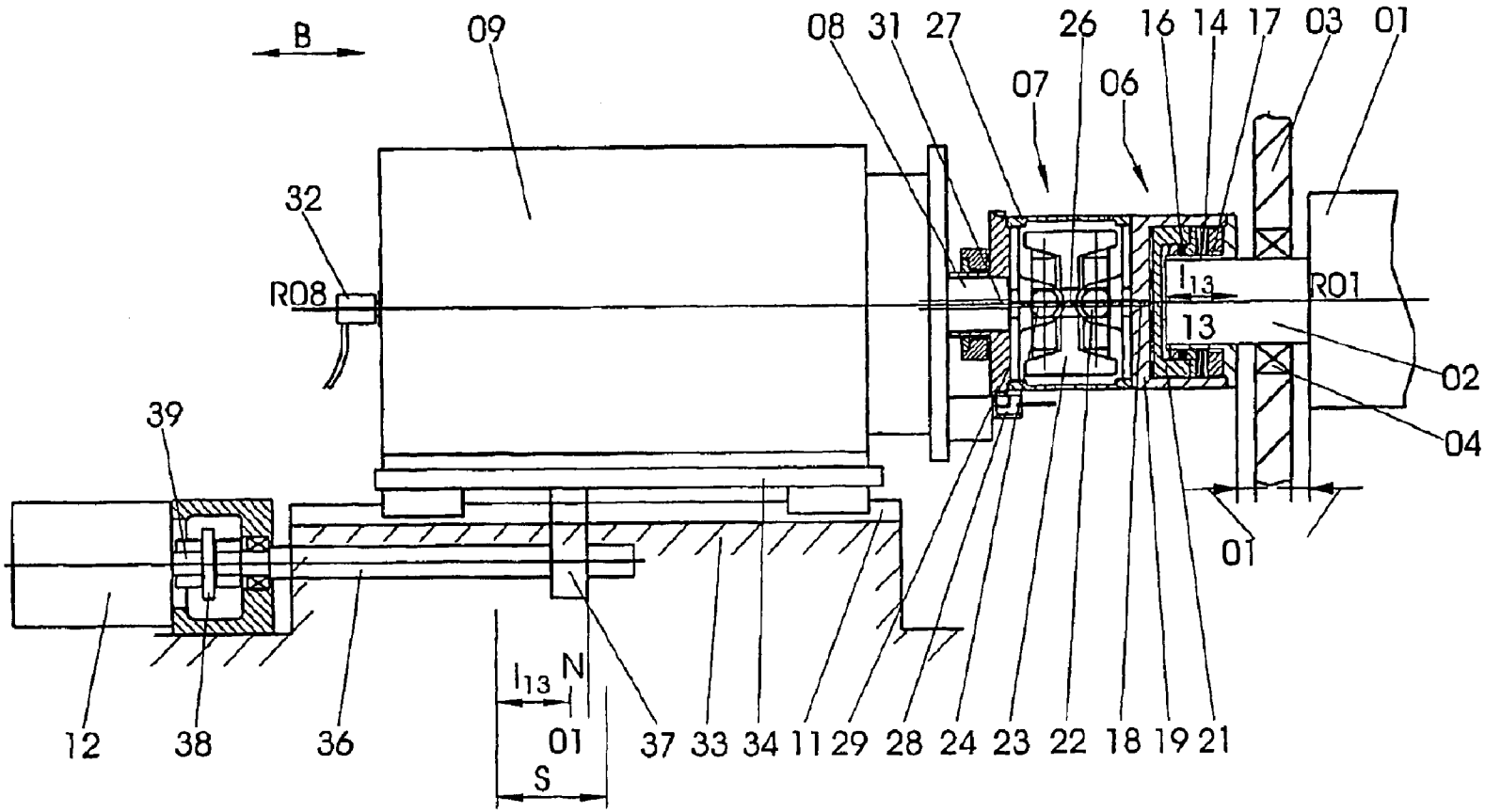
FIG. 1, a schematic representation of a drive mechanism for a rotating component of a printing press in accordance with the present invention.

A rotating component 01, for example a cylinder 01 or a roller 01 of a rotary printing press, and in particular a forme cylinder 01 of a printing press for rotogravure printing, is seen in FIG. 1 and has a journal 02 on its end, by use of which journal 02 the cylinder 01 is seated in a lateral frame 03 of a printing press by the use of a bearing 04. The bearing 04 can be a rolling bearing, for example. If the cylinder 01 is intended to be displaceable in its radial direction, the bearing 04 can also be configured as an eccentric bearing 04. In a possible configuration, the bearing 04 is structured in such a way that a relative movement between the lateral frame 03 and the journal 02 in the axial direction of the cylinder 01 is possible. To simplify the removal of the cylinder 01, the bearing 04 and/or the lateral frame 03 can be structured to be open toward one side of their circumferences, so that the cylinder 01 with its journal 02 can be removed, for example toward the top, from the lateral frame 03.

In the operational state of the rotary printing press, the journal 02 of the cylinder 01 is connected by a first, releasable coupling 06 and a second coupling 07, which compensates angular deviations, for example a link or universal joint 07, with a shaft 08 of a motor 09. The motor 09 drives the cylinder 01 in a rotating manner during production and, if required, also during the setup of the printing press. In a preferred embodiment, the motor 09 is arranged coaxially with respect to an axis of rotation R01 of the rotating component 01. The shaft 08, or the axle 08 of the motor 09 can preferably be embodied as a rotor 08 of the motor 09. The motor 09 is arranged on, and is supported by a guide element 11. Accordingly, motor 09 can be moved in a linear direction, as indicated by arrow B, approximately parallel with the axial direction or parallel to the axis of rotation R01 of the cylinder 01 by the operation of an actuating drive 12, which, for example, may be a second motor 12.

In the operational state of the driving member of the present invention, the journal 02 extends, in the form of a partial element 13 of a length l13, for example l13=110 mm, into the end of the first, releasable coupling 06. The releasable coupling 06 which, in the operational state connects the journal 02 in a torsion-proof manner with the second, link or universal joint 07, is embodied in an advantageous manner to be non-positive and, in the operational state, pretensioned, or self-locking and controllable.

In a preferred embodiment, the first, releasable coupling 06 is configured in the form of tensioning elements 16, which are pretensioned by springs 14 carried on a cooperating tensioning bushing 17. The coupling 06 is releasable when a medium charged with pressure, for example a pressure medium such as oil in particular, is conducted by a conduit 18 into a housing 19 of the coupling 06 and is placed, under pressure between the housing 19 and an axially displaceable piston 21. By the application of this pressurized fluid to the piston 21, the springs 14 are compressed against their pretension and relieve the tensioning elements 16 acting together with the tensioning bushing 17. Star disks 16, for example, can be used as the tensioning elements 16. However, the first, releasable coupling 06 can also be embodied as a controllable coupling in a different way, for example as a cone coupling, as a disk coupling, or as an electromagnetic or fluid coupling.

On its side facing away from the cylinder 01, the first, releasable coupling 06 is connected with the second coupling 07, in the preferred embodiment with a first joint component 22 of the link or universal joint 07. In the preferred embodiment, the link or universal joint 07 is embodied as a double joint 07, having the first joint component 22, a shaft 23 and a second joint component 24, which link or universal joint 07 compensates for possibly existing angles and/or an offset between an axis of rotation R08 of the shaft 08 of the motor 09 and an axis of rotation R01 of the cylinder 01. The latter offset may occur, in particular, in case of a seating or of a positioning of the cylinder 01 whose position can be radially changed, for example for placement of the cylinder 01 against or away from the matter to be printed. The joint components 22 and 24 that constitute the link joint 07 can be embodied, for example, as universal joints, as ball-and-socket joints, or in any other form, as a positive connection with changeable angles, which absorb tension and pressure forces in approximate spatial directions along the axes of rotation R01 and R08, and which have the above-mentioned compensating properties in relation to angle and offset. In an advantageous manner, a line or conduit 26, which conveys the pressure medium and which is connected with the conduit 18, with line or conduit 26 being, for example a hose 26, is passed through the double joint 07. In the preferred embodiment, the line 26 is passed centrally through the shaft 23 of the link joint 07.

The second joint component 24 of the link joint 07 is connected, on its end face, and is centered in relation to the axis of rotation R08, with the shaft of the motor 09. In a preferred manner, the arrangement of the first, releasable coupling 06 and the second, link joint 07 is encapsulated by a cover 27 which extends from the motor shaft 08 to the journal 02.

In one embodiment of the present invention, the shaft 08 of the motor 09 has a pulse transducer 28 on its rotating jacket surface, which pulse transducer 28 acts together with a sensor, that is not specifically represented, and whose angular position provides information at any time regarding the rotational position and/or speed of rotation of the cylinder 01. In a preferred embodiment, the pulse transducer 28 may be arranged on the circumference of the rotating releasable first coupling 06, or on the second, link coupling 07 itself. The pulse transducer 28 may be arranged on the circumference of a front or end face 29 of the second, link coupling 07 which end face 29 engages the second joint component 24 of the link joint 07 and which is acting together with the shaft 08. A synchronous movement between the rotating component 01 and the pulse transducer 28, via the torsion-proof second, link coupling 07 is assured by this positioning of the pulse transducer 28.

The shaft 08 of the motor 09 preferably has a centrally arranged bore 31, through which the pressure medium reaches the first, releasable coupling 06 via the line 26. The supply of a pressure medium for actuating the coupling 06 can be accomplished in a simple manner, for example via a rotary lead-in 32 through the shaft 08 of the motor 09 and via the line 26 to the conduit 18 of the coupling 06. Seating of the shaft 08 in the motor 09 is preferably provided by a radial bearing, which is not specifically represented, which seating or support of a shaft 08 also absorbs a force component in an axial direction, which is approximately parallel in respect to the axis of the motor rotation R08, for example by use of an inclined bearing, so that a relative axial movement between the shaft 08 and the motor 09 is prevented. The position of the stator of the motor 09, which is seated on the guide element 11 and the rotor, or the shaft 08, cannot be axially changed in relation to each other. The motor 09 preferably is an electric motor 09 that is controlled via its angle of rotation, or that is positionally controlled.

The motor 09 is arranged approximately parallel in relation to the axis of rotation R08 by the use of the guide element 11, for example on a support 33, and is linearly movable in the movement direction B. In the preferred embodiment, the support 33 is fixed in place in respect to the lateral frame 03, and the guide element 11 is configured as a linear guide 11. The guide element 11 between the motor 09 and the support 33 can be configured as a flat or as a dove-tailed guide element, wherein a movement as smooth-running as possible in the forward direction, and a seating as free of play as possible in all remaining directions, will be assured. For this purpose, feet 34 arranged on the motor 09 and acting together with the guide element 11, or the guide element 11 itself, have rotary bearings, which are not specifically represented in the sole drawing.

In the present embodiment, the motor 09 can be linearly displaced in the direction of movement B by operation of the second motor 12 via a threaded drive mechanism 36, which may be, for example, a threaded spindle 36 with a trapezoidal thread. The threaded spindle 36 is in engagement with an interior thread that is arranged in the motor 09, and which is fixed in place in respect to the motor 09. The interior thread can be a part of a nut 37 that is fastened on the motor 09. To minimize possibly occurring thread play between the threaded spindle 36 and the nut 37, a second, adjustable nut can be arranged, for example, or other steps can be taken.

The threaded spindle 36 is rotatably supported, but is fixed axially in place with respect to the support 33 and, in an advantageous embodiment, is directly driven through a third coupling 38 between a shaft 39 of the second motor 12 and the threaded spindle 36, for example a universal joint coupling, which compensates for angular deviations. The rotary position of the second motor 12 is also controlled in the preferred embodiment, which makes possible the exact positioning of the first motor 09 in the direction of movement B. However, positioning can also be provide via path-detecting sensors at the threaded spindle 36. The driving of the threaded spindle 36 can also be performed via a drive mechanism, in which case appropriate precautions regarding possible thread play must be taken.

In the preferred embodiment, the entire regulating distance S, starting at a zero position N, in the direction extending away from the cylinder 01, has at least the length l13 of the portion of the journal 02 projecting into the first, releasable coupling 06. In order to make possible a correction of the cylinder 01, or an adjustment of the side registration, in the axial direction, by a regulating distance d01, for example by d01=±10 mm, a regulating distance d01 in respect to the zero position N of at least 10 mm in both directions is required, wherein a distance a03 between the lateral frame 03 and the coupling 06, as well as a distance a01 between the cylinder 01 and the lateral frame 03, must be of corresponding size.

The manner of functioning of the drive mechanism in accordance with the present invention for a rotating component 01 of a printing press is as follows:

A correction of the axial position of the cylinder 01, for example by the regulating distance d01 in the direction toward the lateral frame 03, takes place by actuating the second motor 12, for example over an appropriately standardized angle of rotation, and the rotating threaded spindle 36. The first motor 09 is linearly displaced in the direction of movement B in relation to the lateral frame 03, and, in turn, moves the cylinder 01 via the second link joint 07, which can be charged with tension and pressure, in the direction toward the lateral frame 03. In the course of this correction, the coupling 06 is engaged, and also represents a connection which can be charged with tension and pressure.

However, if the cylinder 01 and the drive mechanism are to be uncoupled, or even separated from each other, first the release of the first coupling 06 takes place by charging the first coupling 06 with the pressure medium. Now the cylinder 01 can be freely turned around its axis of rotation R01, or its position can be changed linearly along the axis of rotation R01 in relation to the first coupling 06. In order to completely separate the first coupling 06 and the journal 02 spatially from each other, the motor 09, with the second, link joint 07 and the first, releasable coupling 06 is first linearly displaced at least by the length l13 by operation of the second motor 12 and the threaded spindle 36. Now it is no longer necessary to charge the coupling 06 with pressure, so that the coupling 06 can now be relieved of the pressure medium and the cylinder 01 can be removed, or replaced.

While a preferred embodiment of a driving member for a rotating component, and a method for separating the driving member from the rotating component, in accordance with the present invention, have been set forth fully and completely hereinabove, it will be apparent to one of skill in the art that various changes in, for example the overall size of the cylinder, the source of supply of the fluid under pressure and the like could be made without departing from the true spirit and scope of the present invention which is accordingly to be limited only by the following claims.

What is claimed is:

1. A drive mechanism for a rotating component of a printing press comprising:

a motor for driving the rotating component of a printing press;

a journal on an end face of the rotating component;

a first releasable coupling between said journal of the rotating component and said motor;

means for the selective engagement and release of said first releasable coupling with said journal;

means supporting said motor for movement with respect to the rotating component in a direction parallel to an axis of rotation of the rotating component; and an actuating drive for moving said motor with respect to the rotating component in said direction parallel to said axis of rotation of the rotating component.

2. The drive mechanism of claim 1 wherein said motor is movable axially by said actuating drive for selectively effecting a corresponding axial movement of the rotating component in response to said selective engagement of said first releasable coupling with said journal.

3. The drive mechanism of claim 1 wherein said first releasable coupling is movable with respect to said journal in said axial direction of the rotating component when said first releasable coupling is released from said the rotating component.

4. The drive mechanism of claim 1 further including a second coupling between said first releasable coupling and said motor, said second coupling being adapted to compensate for angular deviations between said motor and the rotating component.

5. The drive mechanism of claim 4 wherein said second coupling is a universal joint.

6. The drive mechanism of claim 5 wherein said universal joint is a double joint.

7. The drive mechanism of claim 1 wherein said rotating component includes a journal, said journal having a partial journal element engageable with said first coupling, said partial journal element having a partial journal length and further wherein said motor is movable over a regulating distance with respect to the rotating component, said regulating distance being greater than said partial journal length.

8. The drive mechanism of claim 1 wherein said means supporting said motor includes a guide element.

9. The drive mechanism of claim 1 wherein said actuating device includes a second motor.

10. A drive mechanism for a rotating component of a printing press comprising:

a motor for driving the rotating component, said motor including a motor shaft;

a first releasable coupling between said motor shaft and an end face of the rotating component, said first releasable coupling being adapted for selective engagement and release of said end face, said first releasable coupling being controlled for said selective engagement and release of said end face by a pressure medium supplied to said first releasable coupling;

a means for supplying said pressure medium to said first coupling through said motor shaft; and means supporting said motor for changing a position of said motor in respect to said rotating component in a direction having at least one component parallel to an axis of rotation of the rotating component.

11. The drive mechanism of claim 10 wherein said means for changing said position of said motor includes a guide element.

12. The drive mechanism of claim 10 wherein said means for changing a position of said motor includes a second motor.

13. A drive mechanism for a rotating component of a printing press comprising:

a motor for driving the rotating component for rotation about a rotating component axis of rotation;

means supporting said motor for movement in the direction of said axis of rotation:

at least a first coupling positioned between said motor and an end face of the rotating component and connecting said motor and said rotating component for said axial movement of said motor, said coupling having a circumference; and a pulse transducer on said circumference of said at least first coupling, said pulse transducer being adapted to provide information of a speed of rotation and of an angle of rotation position of said motor, said pulse transducer being useable to control a number of revolutions and said angle of rotation position of said motor.

14. A method for separating a drive mechanism and a rotating component in a printing press including:

providing a rotating component in a printing press:

supporting said rotating component for rotation about an axis of rotation;

providing a motor having a motor shaft;

providing a releasable coupling on an end of said motor shaft;

selectively connecting said motor shaft with said rotating component for driving said rotating component by using said releasable coupling:

charging said releasable coupling with pressure acting in said axis of rotation direction of said rotating component when said releasable coupling is selectively disconnecting said motor shaft and said rotating component;

providing an actuating drive for said motor;

supporting said motor for linear movement in a direction having at least one component parallel to said axis of rotation direction of said rotating component;

disengaging said motor shaft and said releasable coupling from said rotating component by disconnecting said releasable coupling; and moving said motor in said axis of rotation direction of said rotating component after releasing said coupling and said motor shaft from said rotating component.

15. The method of claim 14 further including providing a journal on said rotating component, engaging a partial element of said journal, having a partial element length, with said releasable coupling, and moving said motor on a guide element over a regulating distance, said regulating distances being greater than said partial element length.

16. The method of claim 14 further including providing said coupling as a pressurized fluid releasable coupling.

* * * * *